US010071469B2

(12) United States Patent
Gallegos

(10) Patent No.: US 10,071,469 B2
(45) Date of Patent: Sep. 11, 2018

(54) FOLDOUT HAND TOOL

(71) Applicant: Robert Joseph Gallegos, Fremont, CA (US)

(72) Inventor: Robert Joseph Gallegos, Fremont, CA (US)

(73) Assignee: Joe Gallegos Design LLC, Fremont, CA (US)

( * ) Notice: Subject to any disclaimer, the term of this patent is extended or adjusted under 35 U.S.C. 154(b) by 133 days.

(21) Appl. No.: 15/137,208

(22) Filed: Apr. 25, 2016

(65) Prior Publication Data

US 2017/0305007 A1 Oct. 26, 2017

(51) Int. Cl.
*B25G 1/08* (2006.01)
*B25B 15/00* (2006.01)
*B25F 1/04* (2006.01)

(52) U.S. Cl.
CPC ..... *B25G 1/085* (2013.01); *B25B 15/008* (2013.01); *B25F 1/04* (2013.01)

(58) Field of Classification Search
CPC ..... B25G 1/085; B25B 15/008; B25F 1/04
USPC ..... 81/440
See application file for complete search history.

(56) References Cited

U.S. PATENT DOCUMENTS 1,530,348 A * 3/1925 Blom ..... A24F 9/04 131/243
4,815,346 A 3/1989 Littlehorn
5,320,004 A * 6/1994 Hsiao ..... B25B 13/56 81/177.4
5,581,834 A 12/1996 Collins
5,791,211 A 8/1998 Bondhus et al.
5,803,584 A 9/1998 Chung
5,983,759 A 11/1999 Turner
6,088,861 A 7/2000 Sessions et al.
6,257,106 B1 6/2001 Anderson et al.
6,279,435 B1 8/2001 Zayat, Jr.
6,357,068 B1 3/2002 Seber et al.
6,397,709 B1 6/2002 Wall
6,640,675 B1 11/2003 Chuang
6,751,819 B2 6/2004 Chuang
D494,438 S * 8/2004 Falkenstein ..... D10/2
6,880,435 B2 * 4/2005 Hawkins ..... B25B 13/56 7/138
7,467,574 B1 12/2008 Lin
7,810,415 B2 10/2010 Adamany et al.
8,359,954 B2 1/2013 Johnson et al.
8,468,916 B2 6/2013 Johnson et al.
(Continued)

*Primary Examiner* — Hadi Shakeri
(74) *Attorney, Agent, or Firm* — White-Welker & Welker, LLC; Matthew T. Welker, Esq.

(57) ABSTRACT

A generally continuous cylindrical body where a first set of tools and a second set of tools are arranged at the proximate and distal ends of the body to rotate in a specific alternating 180 degree sequence in either an "L" mode or "screwdriver" mode for use. The tools are configured to be positioned at one or more hinge points by screws and shoulder screws. At a proximal end of the tool body, and at the tangent of the circumference of the body at the distal end of each tool; each tool is configured to rotate away from the body to a plurality of angles. The general cylindrical body also provides angled channels or walls with varying angular depths or tool slots where the tools are arranged and retained within the general cylindrical body.

13 Claims, 22 Drawing Sheets

(56) References Cited

U.S. PATENT DOCUMENTS

| | | | | |
|---|---|---|---|---|
| 8,490,523 | B2 * | 7/2013 | Tsai | B25F 1/04 7/118 |
| 8,640,574 | B2 | 2/2014 | Johnson et al. | |
| 8,875,601 | B2 | 11/2014 | Johnson et al. | |
| 8,925,429 | B2 | 1/2015 | Johnson et al. | |
| 9,701,005 | B2 * | 7/2017 | Johnson | B25F 1/04 |
| 2001/0045145 | A1 | 11/2001 | Legg | |
| 2007/0221017 | A1 | 9/2007 | Heaven | |
| 2011/0000024 | A1 | 1/2011 | Johnson et al. | |
| 2017/0232603 | A1 * | 8/2017 | Gallegos | B25G 1/085 81/177.2 |
| 2017/0239807 | A1 * | 8/2017 | Gorman | B25G 1/085 |

* cited by examiner

BOTTOM

TOP1

RIGHT

FOLDOUT HAND TOOL

FEDERALLY SPONSORED RESEARCH

Not Applicable

SEQUENCE LISTING OR PROGRAM

Not Applicable

CROSS REFERENCE TO RELATED APPLICATIONS

Not Applicable

TECHNICAL FIELD OF THE INVENTION

The present invention relates to the field of hand held tools. More specifically, the present invention relates to the field of hexagonal tools and related hand tools.

BACKGROUND OF THE INVENTION

Hexagonal, Allen, and Torx or starred shaped tools are manufactured and distributed in multiple English and metric sizes. Such tools are usually sold in a set but are also distributed individually. A typical set embodiment includes tools of multiple sizes for either English, metric, or possibly, booth, sometimes connected to a loop, stored in a case with multiple slots for each size, as part of a single unit where they are attached to opposing ends of a body are extended for use with the body acting as the handle for the tool.

In most cases, the tool, to be used efficiently and effectively, such a handheld tool must be able to provide an appropriate number of tool sizes and they must be easily removable from the body for use and just as easy to return to a stored state within or against the body. Many such tools are known in the prior art and they fail from the same shortcomings in that the tool is difficult to grasp and move from a stored position to a usable position either at a perpendicular angle to the tool body being used in an "L" shape, or extended into a "screwdriver" position, where the tool extends in a straight line down the long axis of the tool body. Such a tool, which is difficult for a use to grasp and move the tool with respect to the body creates frustration.

What is needed is a handheld tool that has a body of sufficient length to act as a handle and also provide storage for the tools, which being user friendly in that grasping or moving the tool from a close/stored position is easily done.

SUMMARY OF THE INVENTION

The present invention is a tool handle for holding multiple tools of different sizes during use. The device is comprised of a body with one or more tools secured to the opposing ends of the body by shoulder screws and screws. A top collar and bottom collar are also joined to surround the center of the body.

The top collar and bottom collar, when joined, surround the body of the handheld tool and provide two actions. In a first action a tool secured to the body end in the direction to collars are pushed is raised away from the body when the collars are push in a first direction. In a second action, the collars are moved in the opposite direction along the body which results in additional finger space being available. The present invention can be made and used with either a single/first action collar or a dual action collar.

In a third embodiment, a generally continuous cylindrical body with a first set of tools and a second set of tools are arranged at the proximate and distal ends of the body to rotate in a specific alternating 180 degree sequence in either an "L" mode or "screwdriver" mode for use. The tools are configured to be positioned at one or more hinge points by screws and shoulder screws. At a proximal end of the tool body, and at the tangent of the circumference of the body at the distal end of each tool; each tool is configured to rotate away from the body to a plurality of angles.

The general cylindrical body also provides angled channels or walls with varying angular depths or tool slots where the tools are arranged and retained within the general cylindrical body. The distal end of each tool is tangent to the circumference of the body. Tools are arranged to rotate in a specific alternating 180 degree sequence is three groups where two of the tool groups are split so that the opposing tool group can fit between and under them. This arrangement allows for the large tool to use the same amount of space needed for a larger number of small tools in the same area or footprint in the body.

The tools are perpendicular to the central longitudinal axis of the body in order to specifically reduce the number of screws required to assemble the unit from four, to one with a mating nut. Furthermore, the present invention has only one axis per end, of which all tools are assembled around.

Additionally, the present invention comprises individual channels that are unrelated and not connected from one set or side to any other set or side. Further, in the present invention, the channels are required to be non-connecting from one end to the other end due to the fact that the discrete and individual channels are offset from the discrete and individual channels of the second end. This is done to specifically allow the channels to not intersect with each other, which allow the tools and channels to extend beyond the center line in the direction of the longitudinal axis. This overlapping arrangement sets up a key feature of alternating the keys on the first and second end mounting axes. Alternating the keys along a single axis (per end) achieves the ability of the keys to be positioned near the center of the longitudinal axis, which is the main goal of any foldout invention, and by definition, reduces the required axes and fasteners to one per end rather than the four per end of the prior art.

The unique orientation of each tool within each set is such that the overall shape of the body is generally cylindrical: The present invention is distinguished as an item that comprises specific, unique, and individual angle orientations for each tool, as well as specific alternating and individual rotational directions for each tool for the purpose of avoiding large channel interruptions within a generally continuous cylindrical shape, while at the same time teach that these multiple angles combined with strictly alternating rotation, minimize the width of each of these channels. Each tool is positioned at an angle such that the working (distal) end sits at the tangent to the circumference of the body.

TABLE OF NUMERICAL REFERENCES

1. Screw
2. Body-Foldout
3. Shoulder Screw
4. Tools
5. Washers
6. Collar-Bottom
7. Collar-Top
8. Angled Wall or Ramp

9. Finger scoop
10. Circular shaped body embodiment
11. Teardrop or rounded triangular shaped body embodiment
12. Pentagonal shaped body embodiment
19. Hexagonal shaped body embodiment
20. Refers to the reference element of the body which the distal end of each tool is tangent to, Datum A
21. Refers to the offset of the tool relative to item 20, Datum B
22. A first axes which the tools are mounted, which are perpendicular to Item 24 (FIG. 4), the main axis of the body
23. A second axes which the tools are mounted, which are perpendicular to Item 24 (FIG. 4), the main axis of the body
24. the main axis of the body
X is the nominal position when a tool's distal end is tangent to the body's perimeter; (in combination with the distance between Datum A (20) and
Y Datum B (21) describe the change in position of the tool's distal end as a result of the lateral translation of the ramp (13) as it urges the tool in a rotational direction away from the channel; 6p1 Z describes the additional finger access space as a result of the sliding collar as it is moved in the extreme opposite direction—resulting in the maximum finger access space.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

Figure 1:
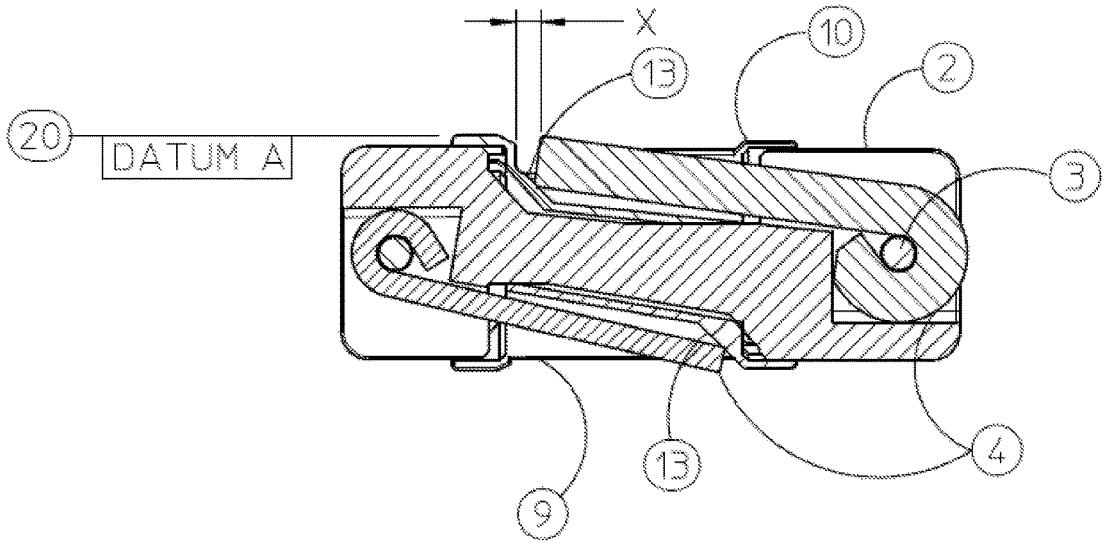
FIG. 1 is a section view of the present invention illustrating the relationship X of the tools and collar with respect to Datum line A in a first embodiment of the present invention.

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is, therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention.

The present invention is a tool handle for holding multiple tools of different sizes during use. In a first, collared embodiment shown in FIGS. 1-9, the device is comprised of a body 2, with one or more tools 4 secured to the opposing ends of the body 2 by shoulder screws 3 and screws 1. A top collar 9 and bottom collar 1 are also joined to surround the center of the body 2. The top collar 9 and bottom collar 10, when joined, surround the body of the handheld tool and provide two actions. In a first action a tool 4 secured to the body end in the direction to collars 9 and 10 are pushed is raised away from the body when the collars 9 and 10 are push in a first direction. In a second action, the collars 9 and 10 are moved in the opposite direction along the body which results in additional finger space being available.

Figure 2:
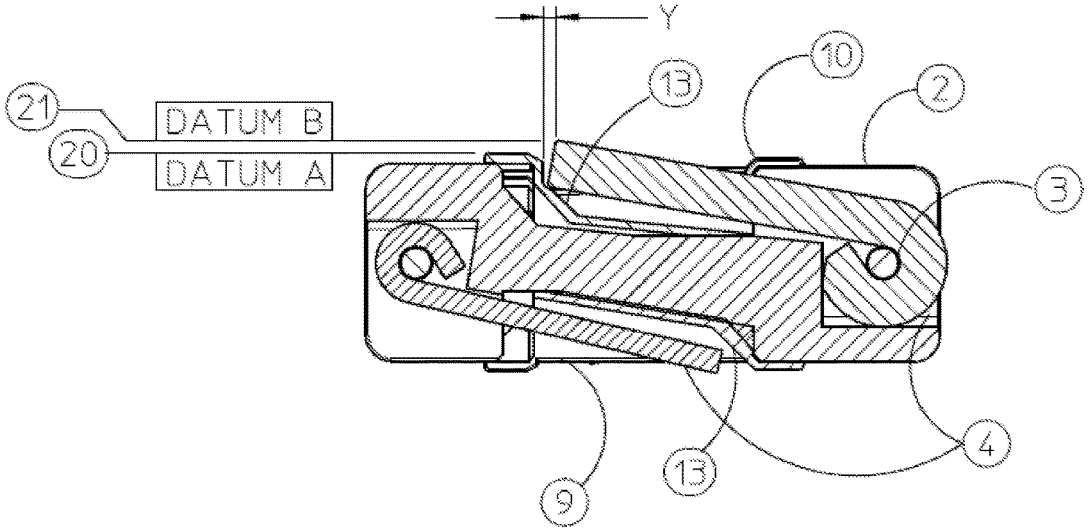
FIG. 2 is a section view of the present invention illustrating the relationship Y of the tools and collar with respect to Datum line B in a first embodiment of the present invention.
Figure 3:
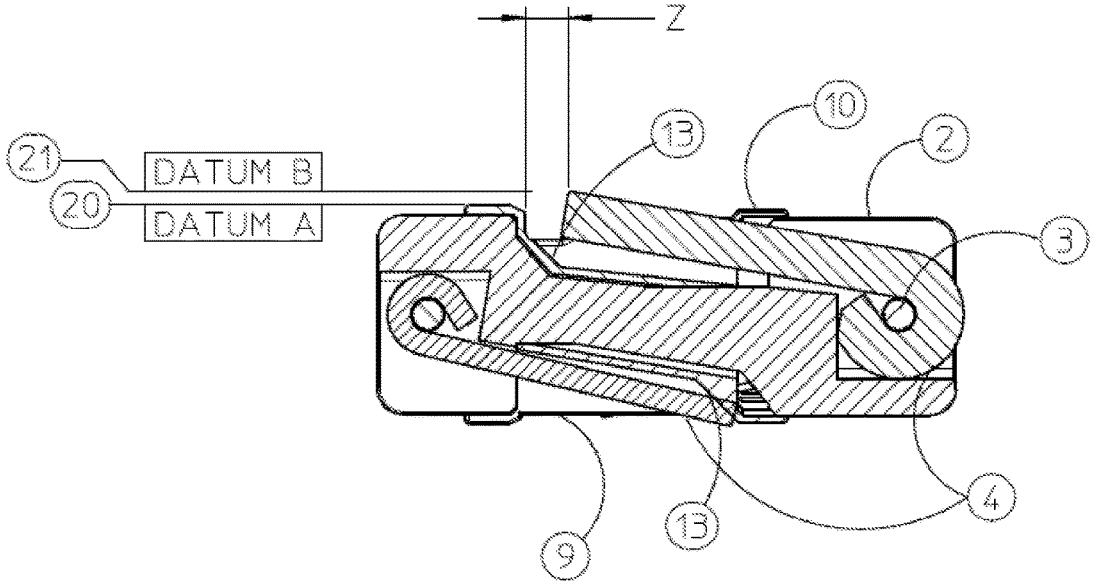
FIG. 3 is a section view of the present invention illustrating the relationship Z of the tools and collar with respect to Datum line A in a first embodiment of the present invention.

FIGS. 1-3 illustrate this double action movement. FIG. 1 specifically illustrates where the distance available to a user for using a finger to grasp and raise a tool 4, when the collars 9 and 10 are in their centered or resting position with respect to Datum A 20 is space X. In FIG. 2, the collars 9 and 10 are slide to Datum B 21, where the bottom of the tool 4 engages an angled collar wall or ramp 13 while the top of the tool is still a distance Y away from the collars 9 and 10 and the tool 4 is slightly lifted. In FIG. 3, the collars 9 and 10 are returned to their position, Datum A 20 and the tool 4 has now been lifted and the new spaced for a user to place a finger to grasp the tool and extend it for use is Z.

X is the nominal position when a tool's distal end is tangent to the body's perimeter; Y (in combination with the distance between Datum A (20) and Datum B (21) describe the change in position of the tool's distal end as a result of the lateral translation of the ramp (13) as it urges the tool in a rotational direction away from the channel; Z describes the additional finger access space as a result of the sliding collar as it is moved in the extreme opposite direction—resulting in the maximum finger access space.

Figure 4:
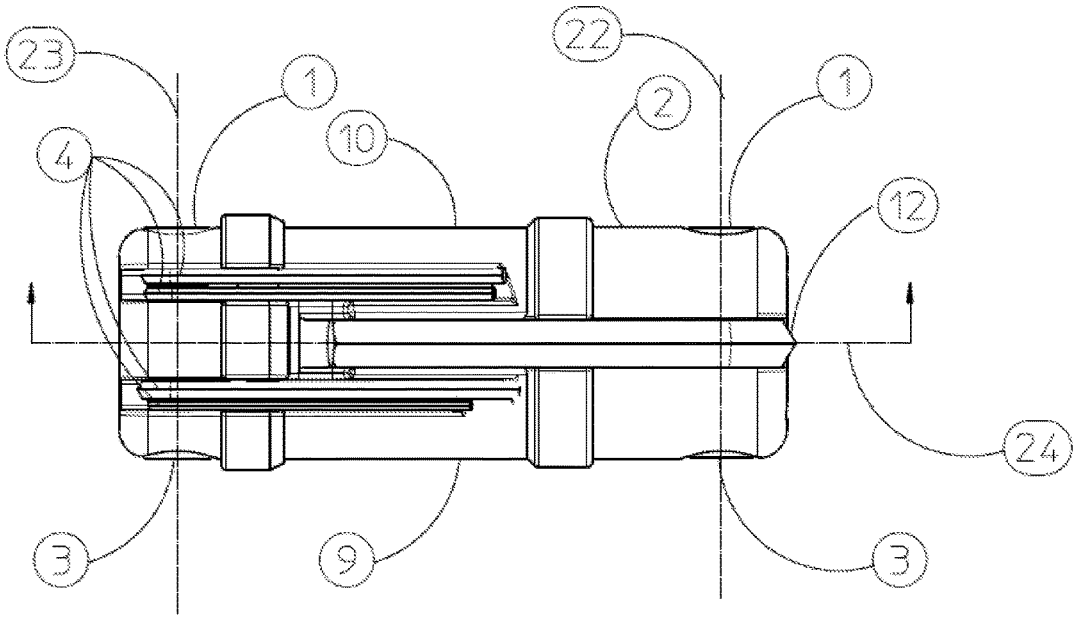
FIG. 4 is a bottom side view of a first embodiment of the device of the present invention.
Figure 5:
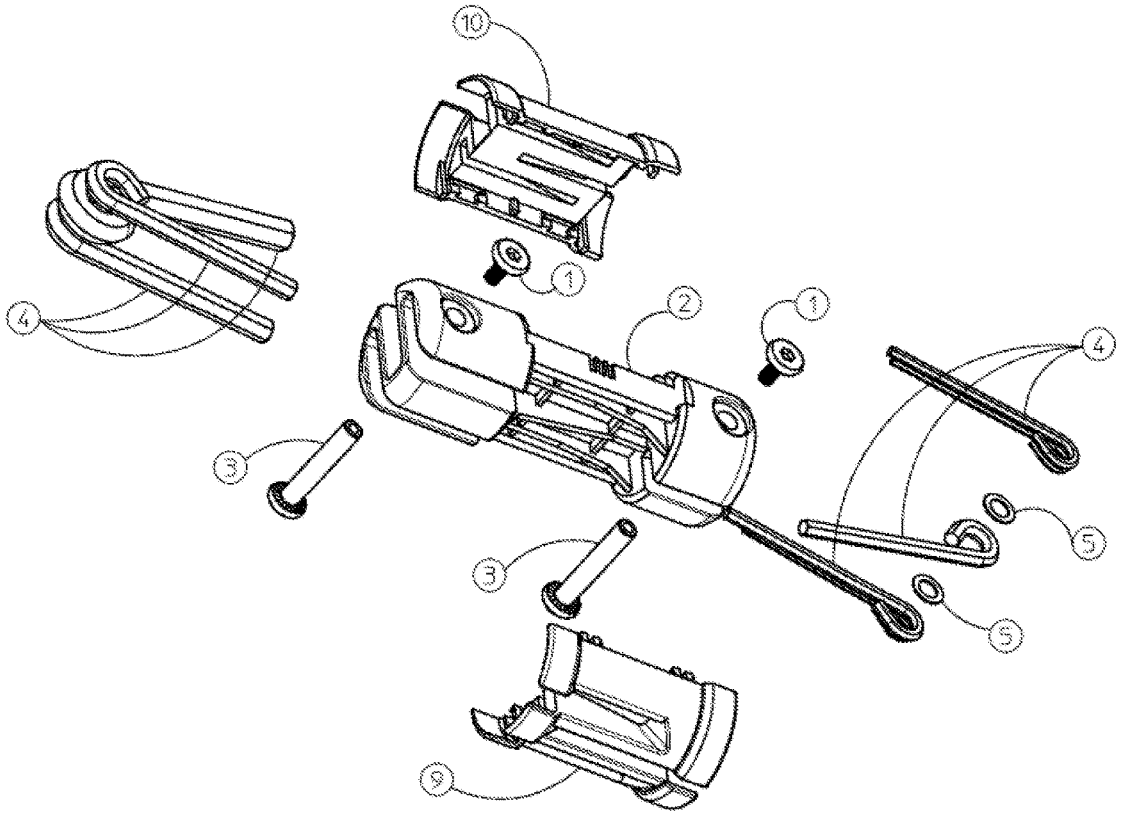
FIG. 5 is an expanded view of the device of the present invention illustrating the body and component parts of a first embodiment of the present invention and their relationship in combination to each other.
Figure 6A:
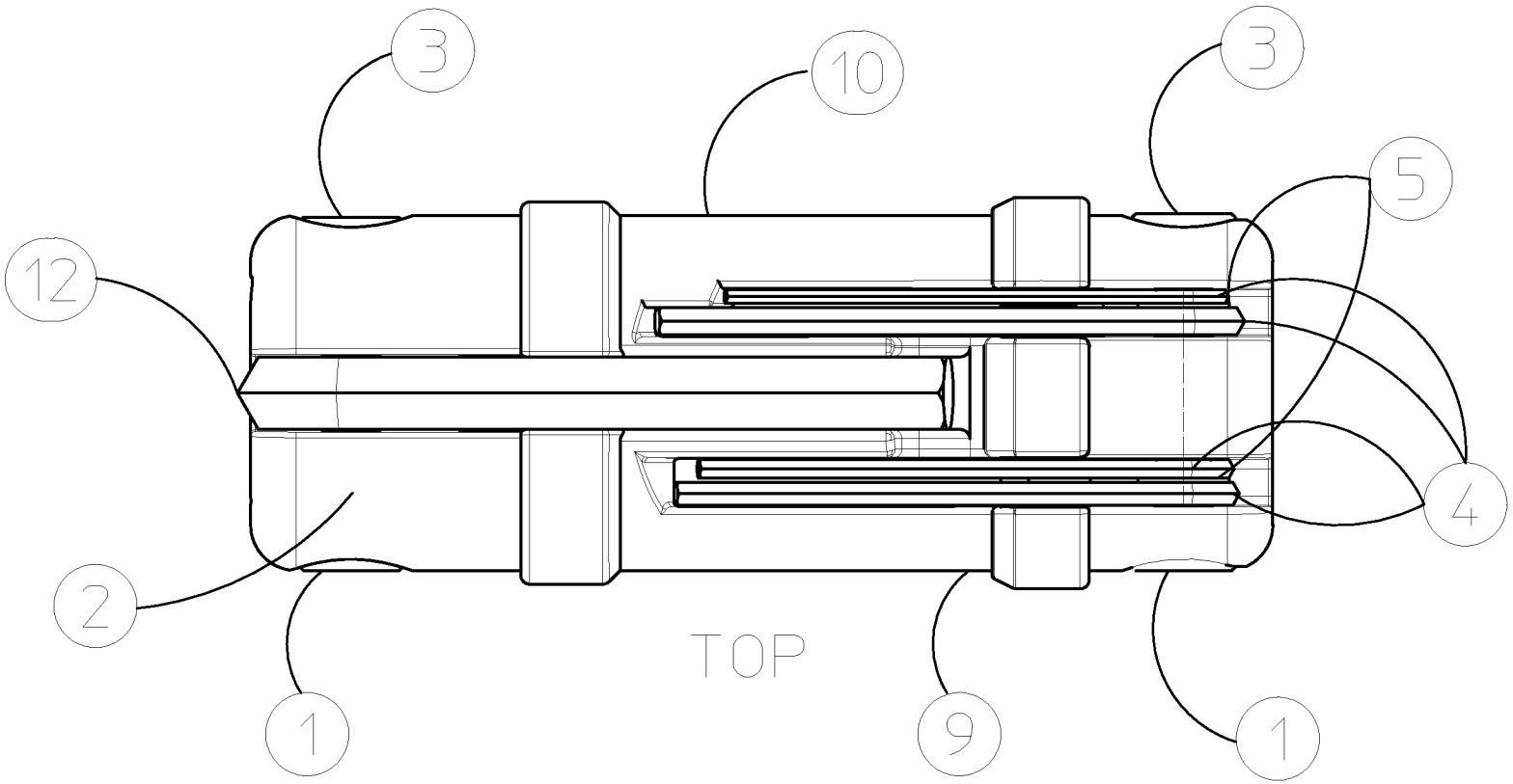
FIG. 6*a* is a top side view of a first embodiment of the present invention.
Figure 6B:
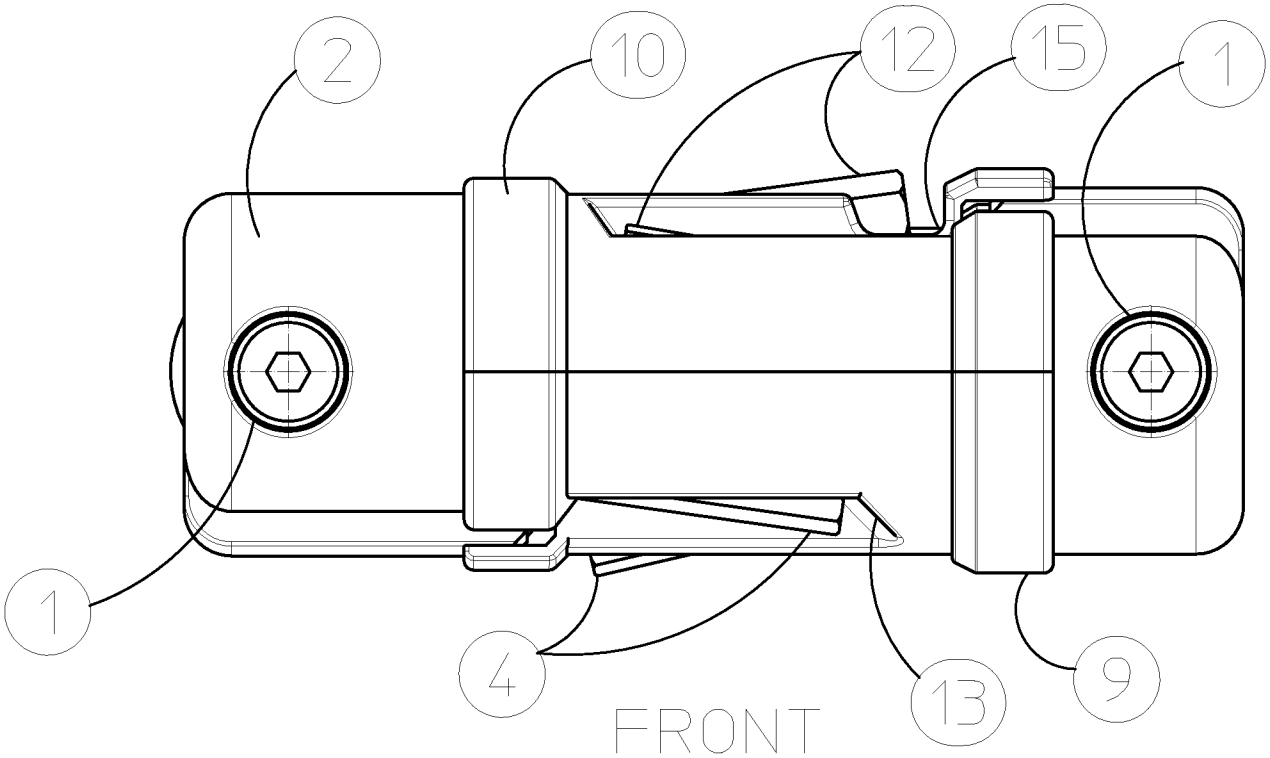
FIG. 6*b* is a front side view of a first embodiment of the present invention.
Figure 6C:
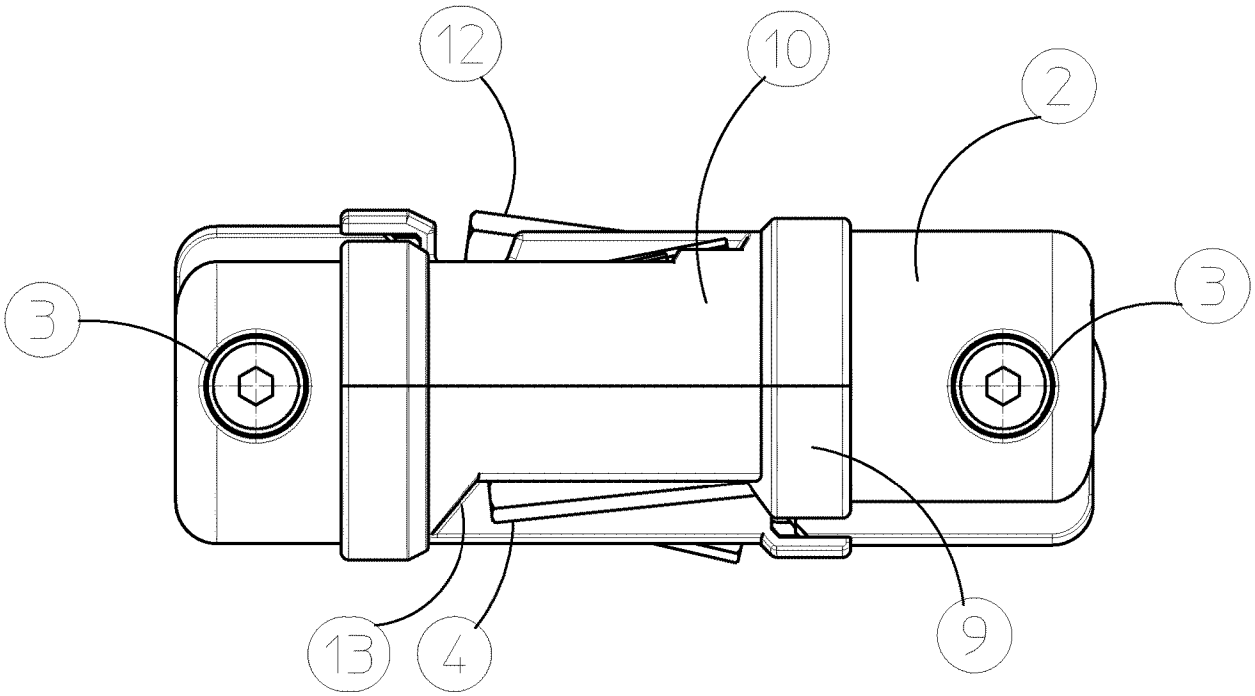
FIG. 6*c* is a back side view of a first embodiment of the present invention.
Figure 6D:
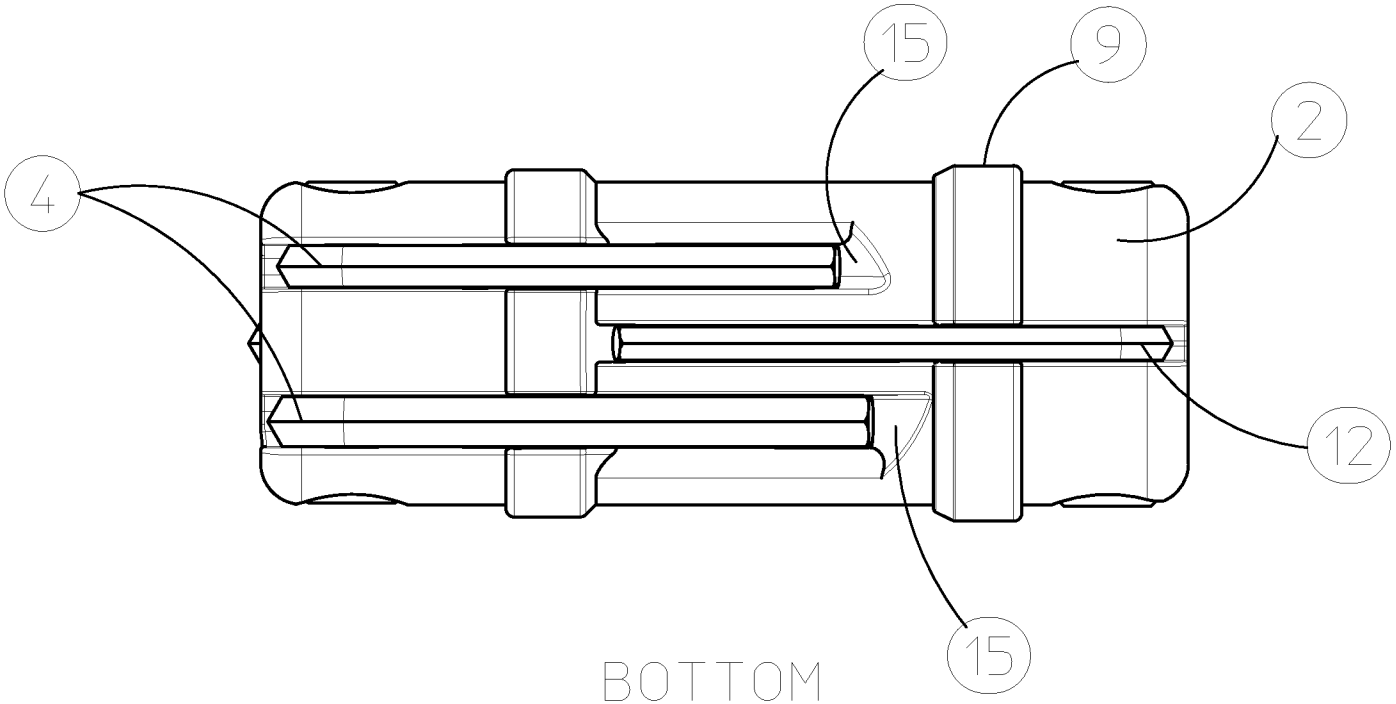
FIG. 6*d* is a bottom side view of a first embodiment of the present invention.
Figure 6E:
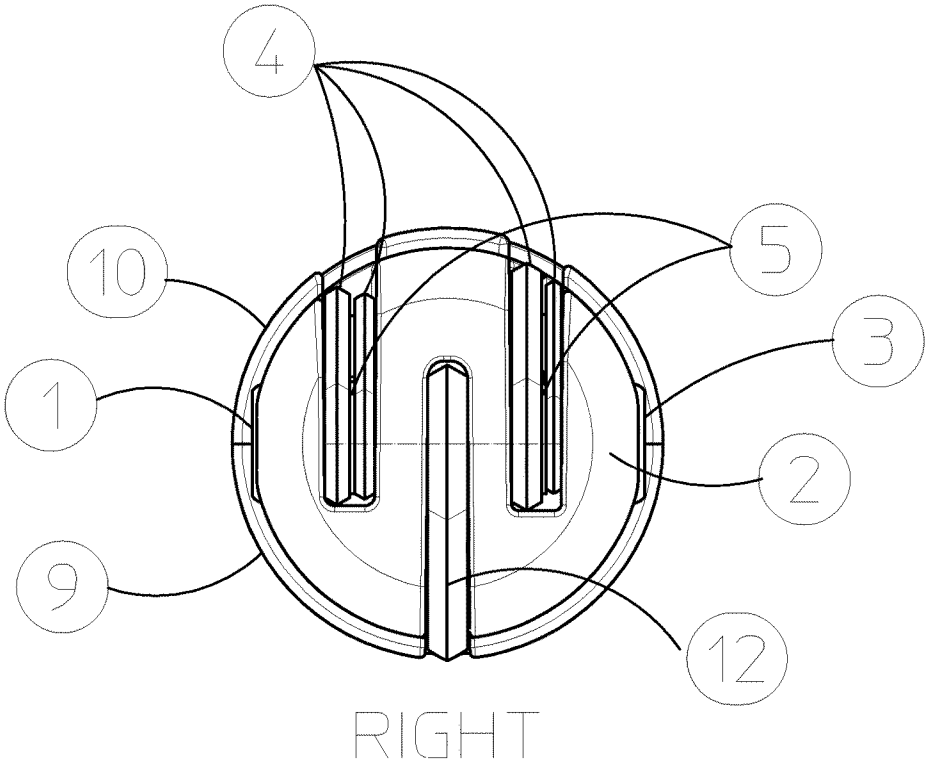
FIG. 6*e* is a right side/end view of a first embodiment of the present invention.
Figure 6F:
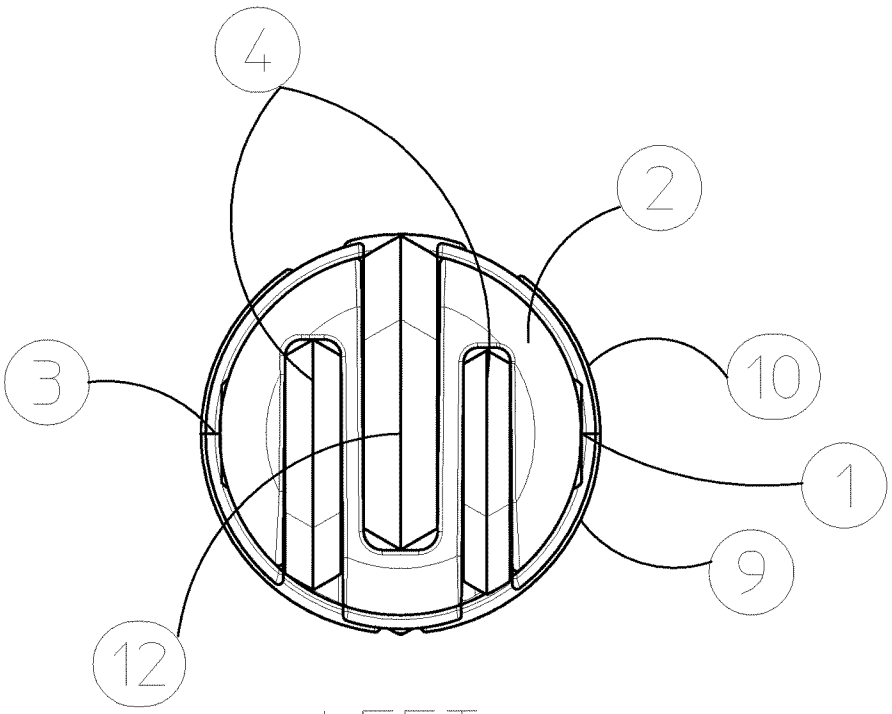
FIG. 6*f* is a left side/end view of a first embodiment of the present invention.
Figure 7:
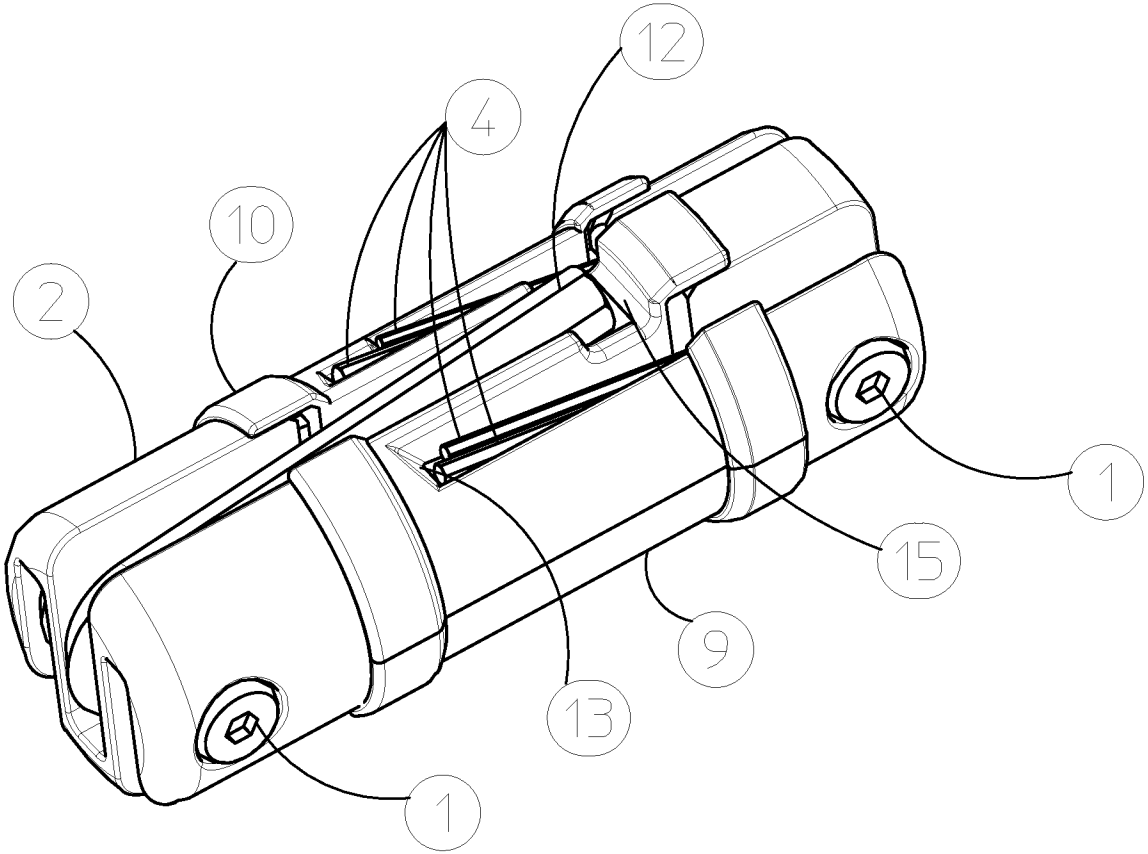
FIG. 7 is a perspective top view of a first embodiment of the present invention.
Figure 8:
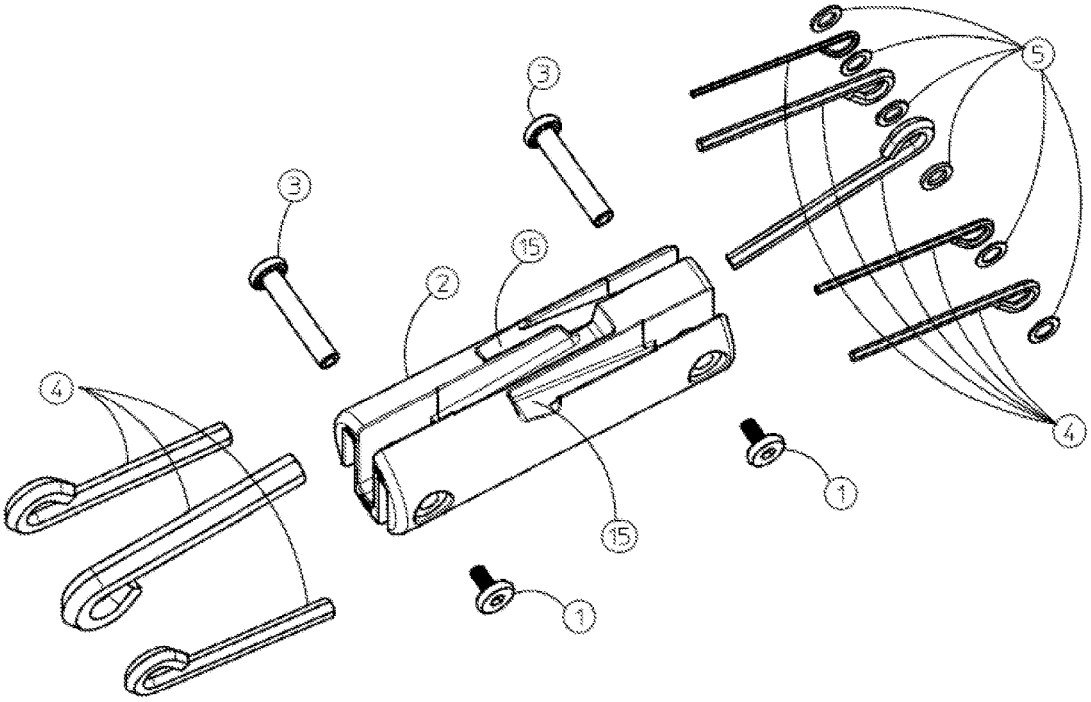
FIG. 8 is an expanded view of a second embodiment of the present invention illustrating the body and component parts of a second embodiment of the present invention and their relationship in combination to each other.
Figure 9A:
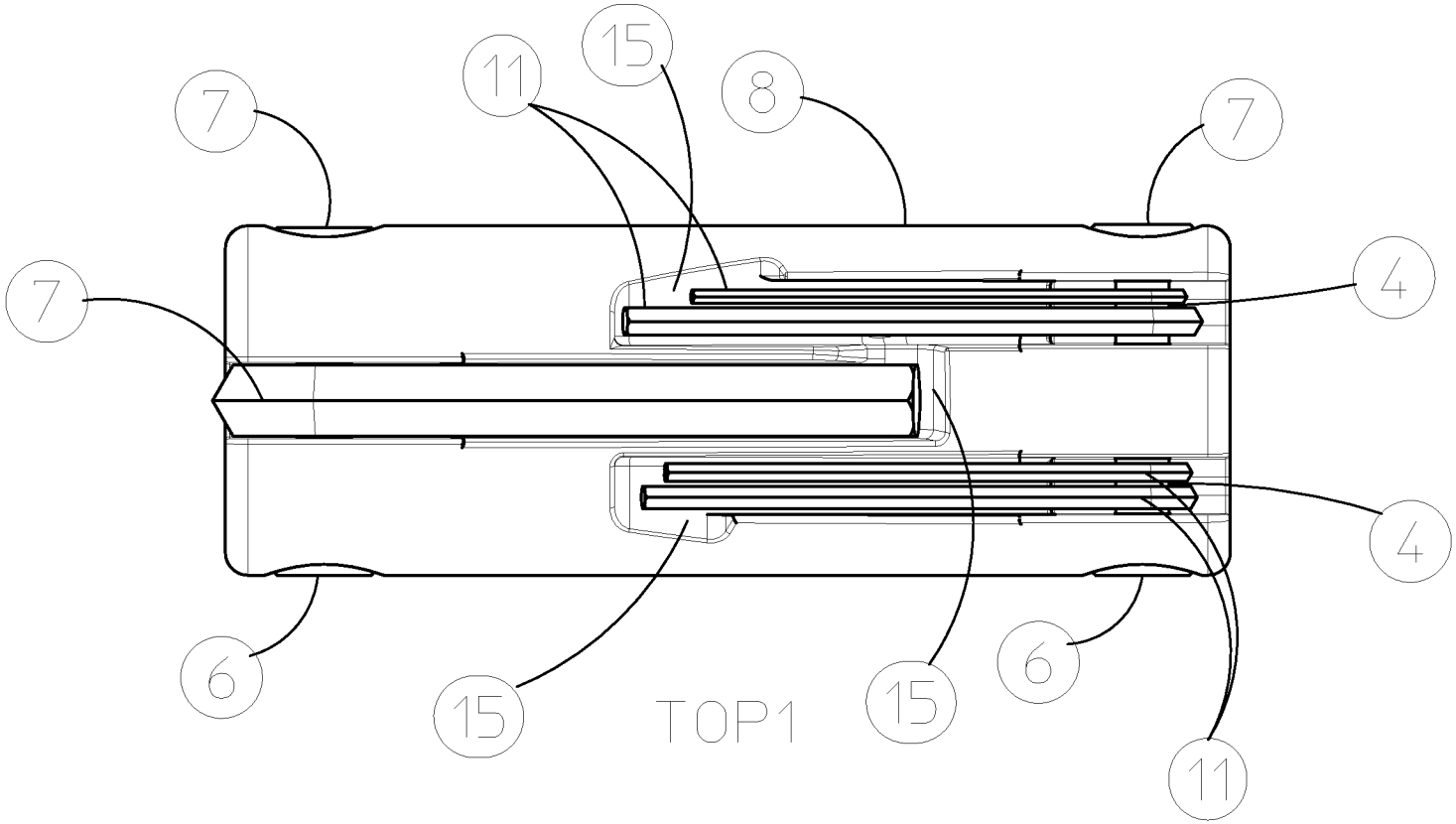
FIG. 9*a* is a top side view of a second embodiment of the present invention.
Figure 9B:
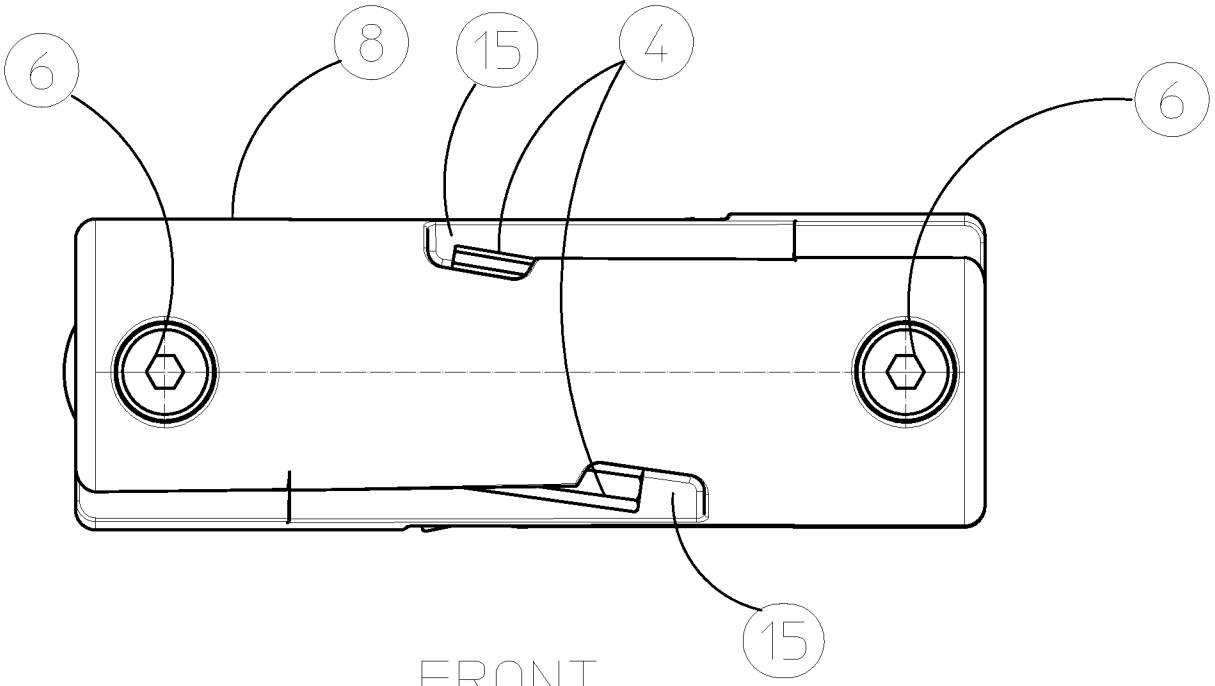
FIG. 9*b* is a front side view of a second embodiment of the present invention.
Figure 9C:
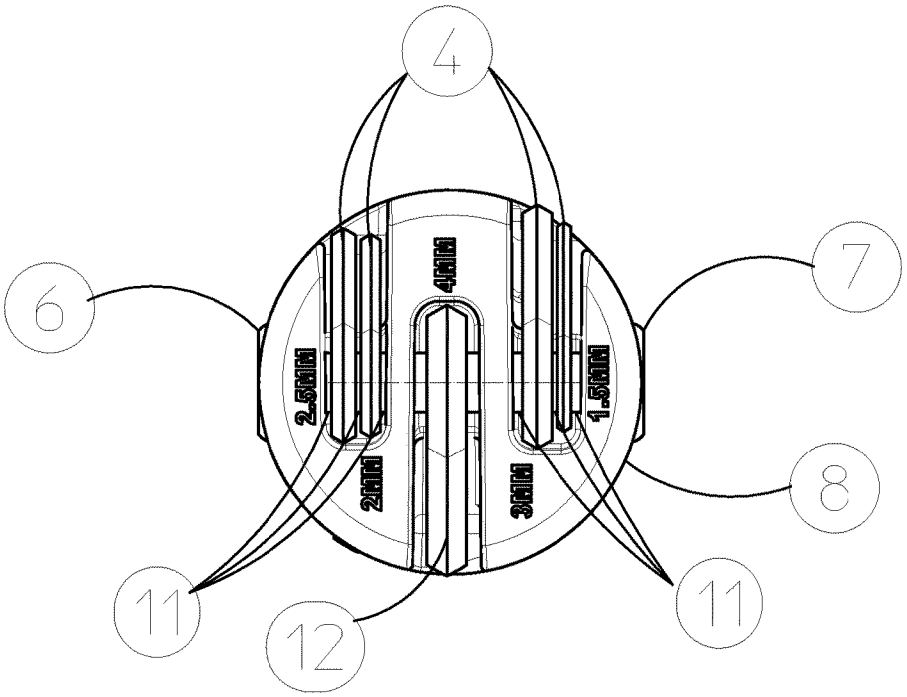
FIG. 9*c* is a right side/end view of a second embodiment of the present invention.
Figure 10:
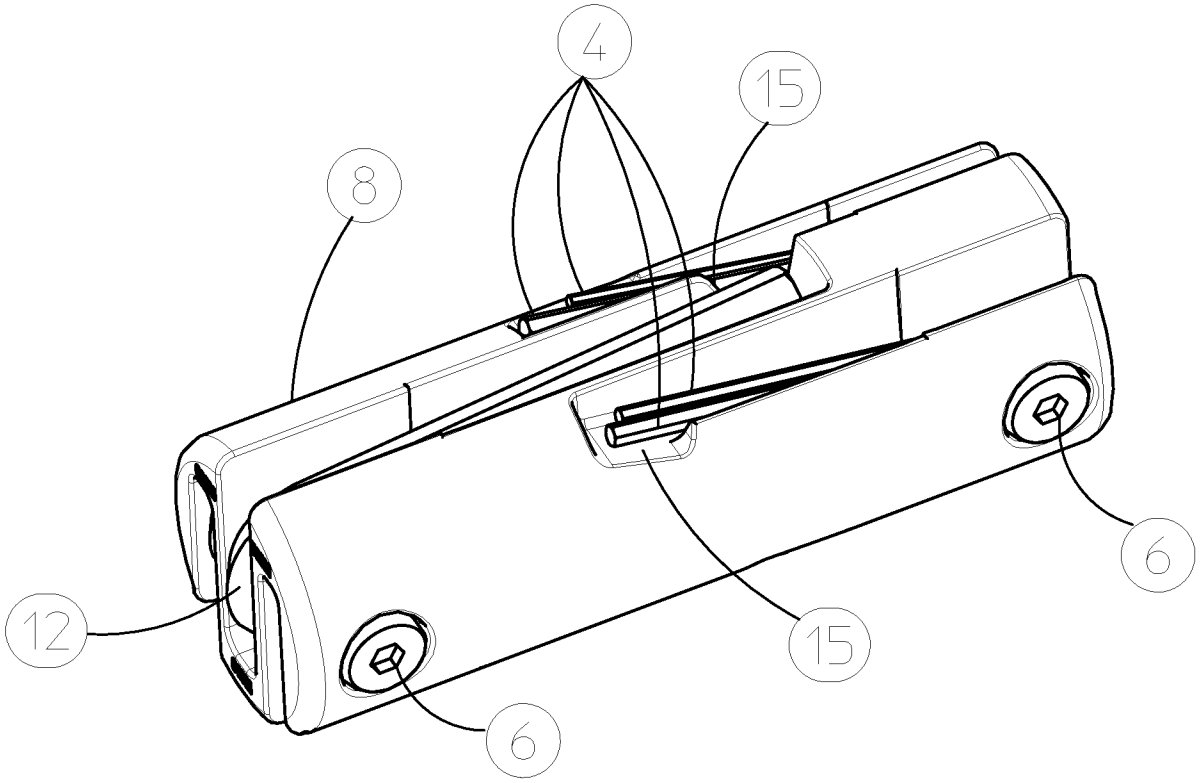
FIG. 10 is a perspective top view of a second embodiment of the present invention.
Figure 11:
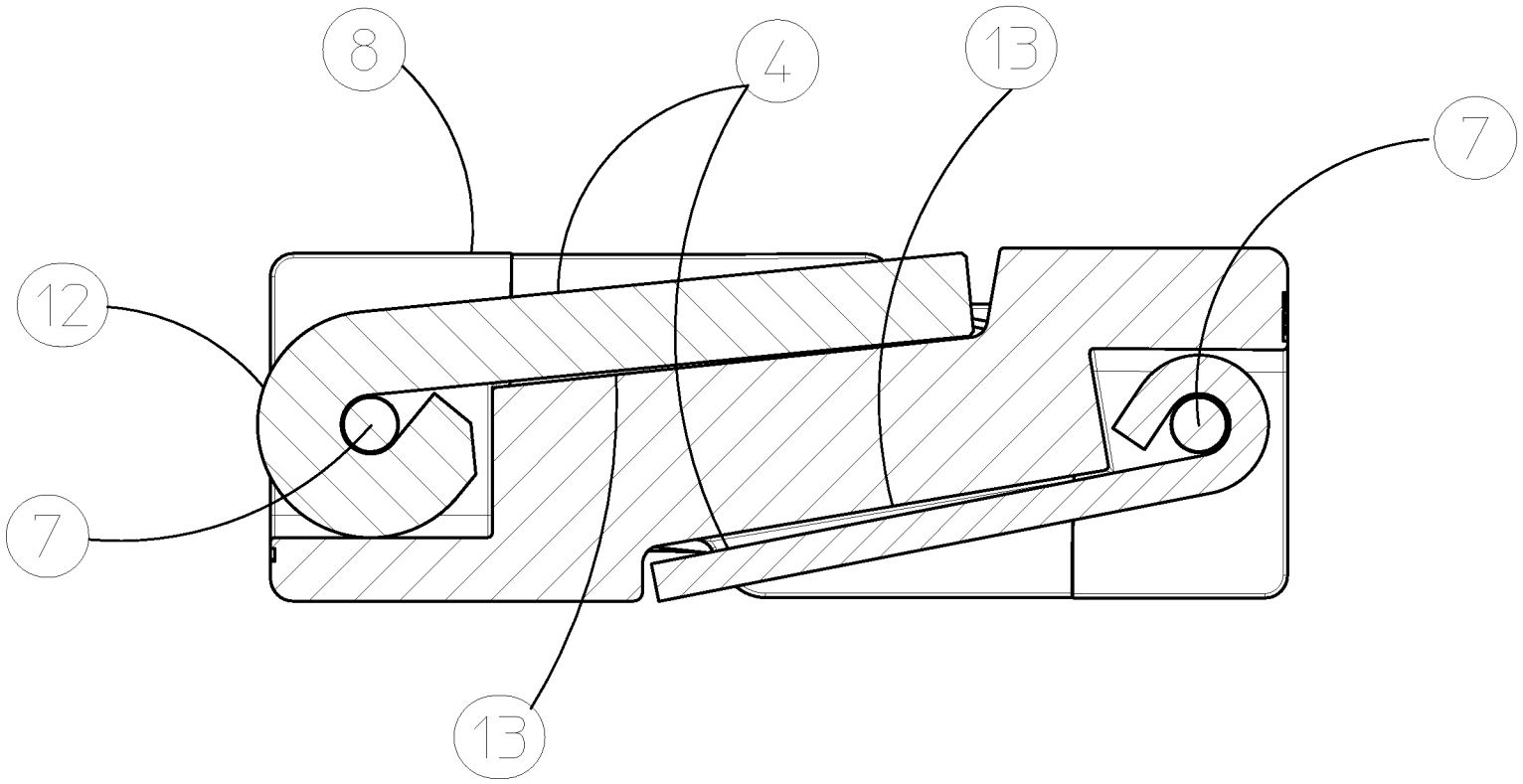
FIG. 11 is a section view of a second embodiment of the present invention.
Figure 12D:
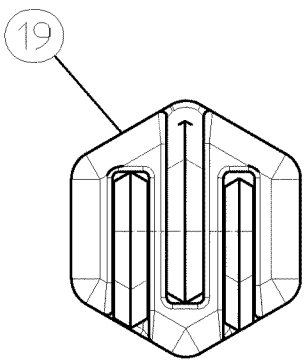
FIGS. 12*a*, 12*b*, 12*c* and 12*d* are end views of the device showing the multiple body shapes of various embodiments of the present invention.
Figure 12C:
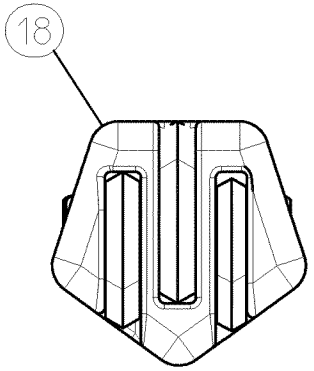
Figure 12B:
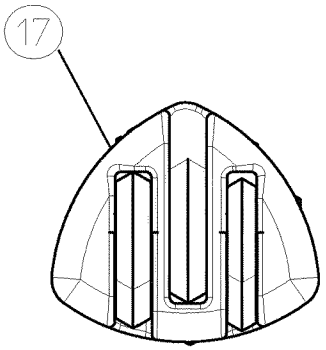
Figure 12A:
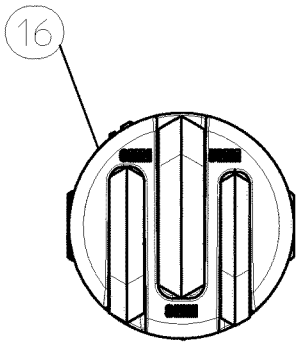

Reference characters 22 and 23 as shown in FIG. 4, describe the axes which the tools 4 are mounted, which are perpendicular to the main axis of the body 24.

In a single action movement use, the tool 4 rotation collars 9 and 10 of the present invention start/rest when the tools 4 are flush or below flush with the body. As the collars 9 and 10 are moved in a single direction toward one end of the body 2, the angled wall or ramp 13 pushes against the tip of the tool 4 to raise it away from the body. This allows the tip of the finger to access and grasp the tools 4 more easily. In the single action movement, only one of the two sets of tools can be moved away from the body, and this is typically the smaller tool sizes as they are the hardest to grasp. With only a single action movement, both tool sets 4 can not be engaged by the angled wall or ramp 13 to raise them away from the body, and there is not action or movement from the closed or resting position in the opposite direction that would give the user additional finger space.

In a third embodiment illustrated in FIGS. 10-14, a generally continuous cylindrical body 2 with a first set of tools 4 and a second set of tools 4 are arranged at the proximate and distal ends of the body 2 to rotate in a specific alternating 180 degree sequence in either an "L" mode or "screwdriver" mode for use. The tools 4 are configured to be positioned at one or more hinge points by screws 1 and shoulder screws 3. At a proximal end of the tool body 2, and at the tangent of the circumference of the body at the distal end of each tool; each tool is configured to rotate away from the body to a plurality of angles.

The general cylindrical body also provides angled channels or walls 13 with varying angular depths or tool slots where the tools are arranged and retained within the general cylindrical body 2. The distal end of each tool 4 is tangent to the circumference of the body 2. Tools 4 are arranged to rotate in a specific alternating 180 degree sequence is three groups where two of the tool groups 4 are split so that the opposing tool group 4 can fit between and under them. This arrangement allows for the large tool to use the same amount of space needed for a larger number of small tools in the same area or footprint in the body 2.

The present invention requires that the tools 4 be perpendicular to the central longitudinal axis of the body in order to specifically reduce the number of screws required to assemble the unit from four, to one with a mating nut. Furthermore, the present invention has only one axis per end, of which all tools 4 are assembled around.

Additionally, the present invention comprises individual channels that are unrelated and not connected from one set or side to any other set or side. Further, in the present invention, the channels are required to be non-connecting from one end to the other end due to the fact that the discrete and individual channels are offset from the discrete and individual channels of the second end. This is done to specifically allow the channels to not intersect with each other, which allow the tools and channels to extend beyond the center line in the direction of the longitudinal axis. This overlapping arrangement sets up a key feature of alternating the keys on the first and second end mounting axes. Alternating the keys along a single axis (per end) achieves the ability of the keys to be positioned near the center of the longitudinal axis, which is the main goal of any foldout invention, and by definition, reduces the required axes and fasteners to one per end rather than the four per end of the prior art.

The unique orientation of each tool within each set 4 so that the overall shape of the body is generally cylindrical: The present invention is distinguished as an item that comprises specific, unique, and individual angle orientations for each tool, as well as specific alternating and individual rotational directions for each tool for the purpose of avoiding large channel interruptions within a generally continuous cylindrical shape, while at the same time teach that these multiple angles combined with strictly alternating rotation, minimize the width of each of these channels. Each tool is positioned at an angle such that the working (distal) end sits at the tangent to the circumference of the body.

Also, unlike the prior art, since each tool varies in size and length, no two tool angles are the same. In the prior art, groups of tools 4 are parallel to each other and also parallel to the central longitudinal axis. Also, in the present invention the tools do not rotate in a plurality of directions as comprised in the prior art, but rotate in a specific alternating sequence around a common axis.

The prior art comprises groups of tools within each channel. The new invention comprises single tools within a single channel, and/or multiple of only the smallest tools within a single channel. The purpose is to minimize the width of each channel and therefore minimize the surface interruptions to the generally continuous cylindrical shape of the body.

Each channel is set at a varying angular depths from the proximal end of each tool to the distal end of each tool, unlike the prior art. The prior art comprises sets of tools within sets of channels that are parallel to the central longitudinal axis of the body. This arrangement precludes minimizing the widths of the channels as well as precluding minimizing the depth of each channel. Since the width of each channel is defined by the number of tools grouped side by side within each channel, then the width cannot be confined to the width of individual tool as in the new invention.

Also, since the depth of each channel of the prior art is defined by the maximum diameter of the largest tool within each group of tools combined with the fact that the channels are parallel to the central longitudinal axis, then each individual channel must be as deep as the largest tool within each group, unlike the new invention. The depth and the width of the channels of the prior art combine to create very large interruptions in a shape that does not achieve a generally cylindrical shape due to these factors.

Additionally, each tool alternates its orientation on the hinge: the largest in the center, and then alternating smaller sizes on either side. The reason is to balance the sizes of each channel around the circumference so that the channels do not become excessively large and interrupt the generally continuous cylindrical surface of the body.

In yet another embodiment, any of the previous embodiments may incorporate a finger scoop 15, where one or more of the distal ends of each tool includes a finger scoop 15 which provides an access area to the distal end of the tool located just inside the body 2. Providing a finger scoop 15 allows the tools 4 to sit deep in the channel for the entire length of the channel, which allows form maximizing the generally continuous cylindrical shape with a minimum of surface interruptions and size of each channel.

The channels would be larger without the scoops 15 because the scoops 15 allow the finger to reach into the channels from the side to rotate the tools out. If the scoops 15 were not present, the channels would need to be either wider, longer, or both which would result in a larger tool to be to fit in the average users hand or a tool that must compromise in the number of wrenches it can hold.

Figures 13A, 13B, 13C, 13D:
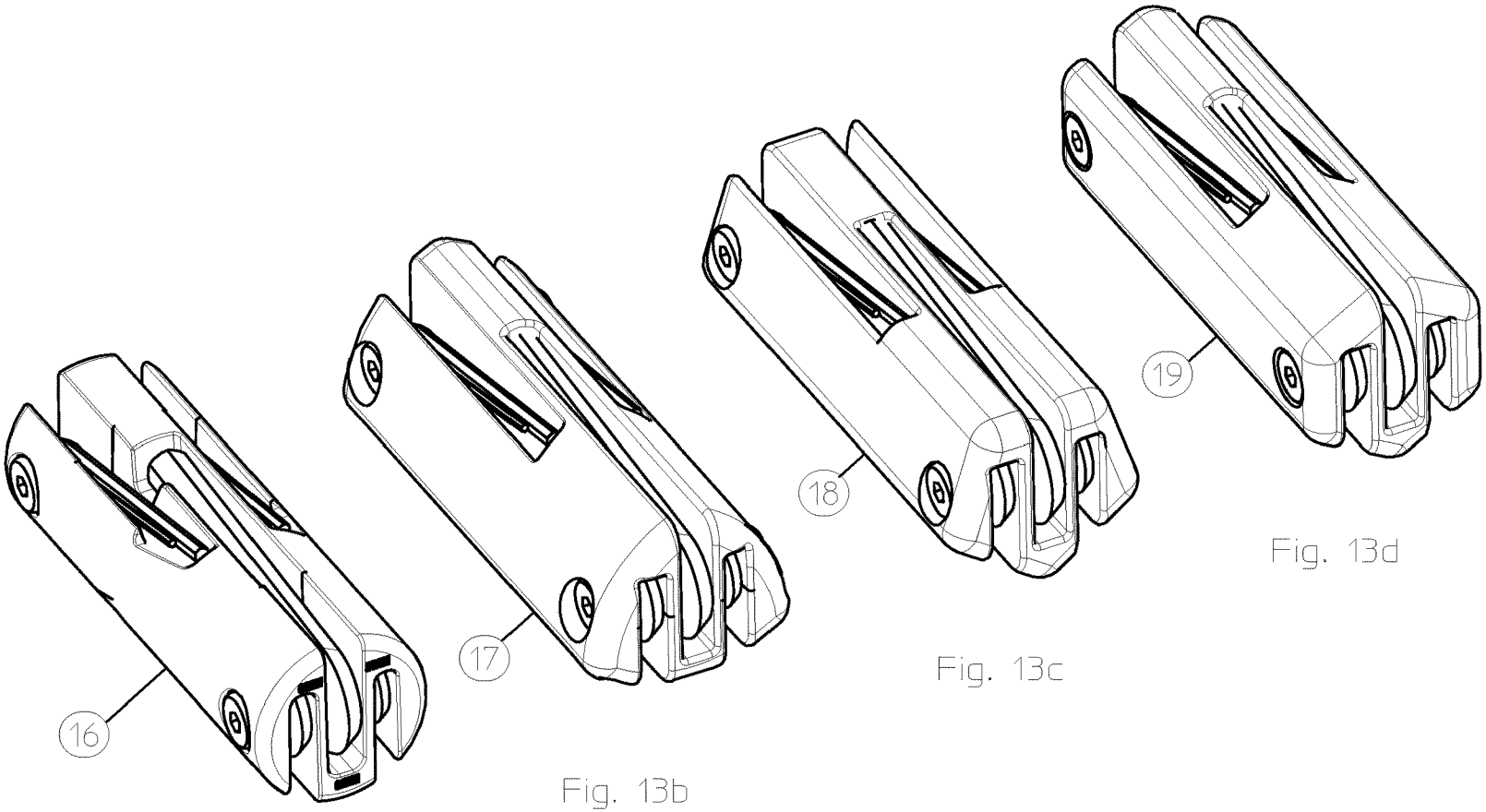
FIGS. 13*a*, 13*b*, 13*c*, and 13*d* are perspective views of the device showing the multiple body shapes of various embodiments of the present invention.
Figure 14D:
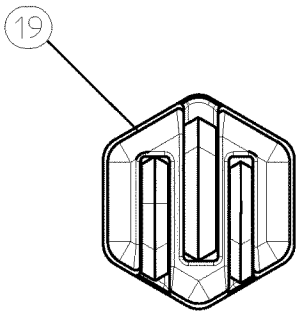
FIGS. 14*a*, 14*b*, 14*c* and 14*d* are end views of the device showing the multiple body shapes of various embodiments of the present invention.
Figure 14C:
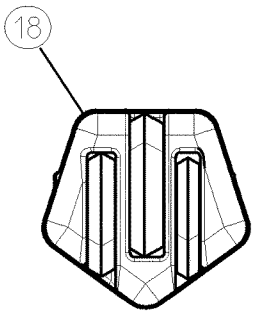
Figure 14B:
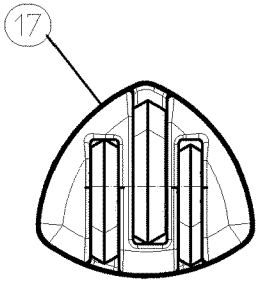
Figure 14A:
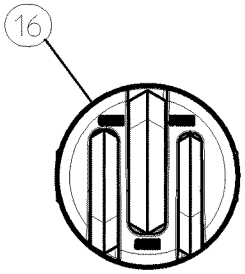
Figure 15D:
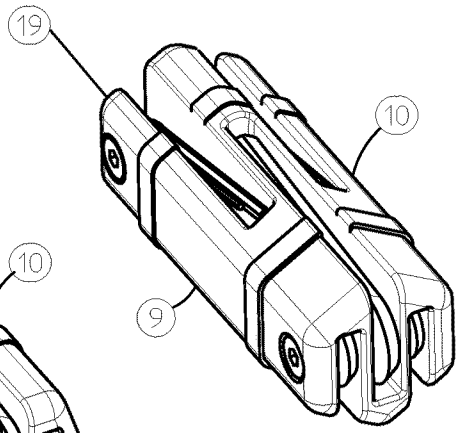
FIGS. 15*a*, 15*b*, 15*c*, and 15*d* are perspective views of the device showing the multiple body shapes of various embodiments of the present invention.
Figure 15C:
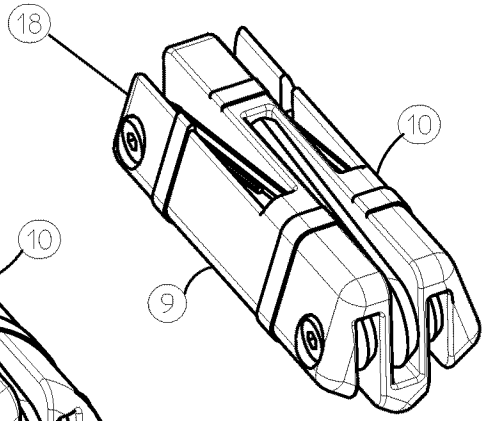
Figure 15B:
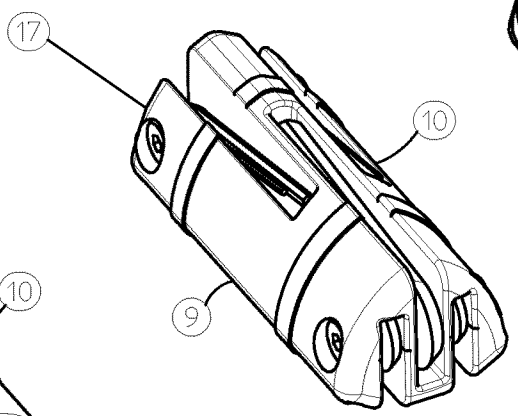
Figure 15A:
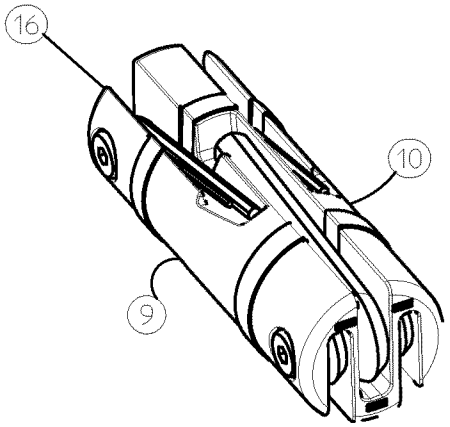

Now referring to FIGS. 12-14, the handle of the present invention is constructed from one body part, and two collars 9 and 10 in one embodiment. The body 2 can be molded so that the exterior shape of the body 2, when in a closed position, is substantially circular or almost circular 16, a teardrop or rounded triangular shape 17, a pentagonal shape 18, or a hexagonal shape 19.

Thus, it is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention.

Thus, it is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention.

Furthermore, other areas of art may benefit from this method and adjustments to the design are anticipated. Thus, the scope of the invention should be determined by the appended claims and their legal equivalents, rather than by the examples given.

The embodiments of the invention in which an exclusive property or privilege is claimed are defined as follows:

1. A utility tool comprising:

a generally continuous cylindrical body;

a two part collar, encircling the center of the cylindrical body;

a first set of tools arranged to rotate in a specific alternating 180 degree sequence;

the tools configured to be positioned at one or more hinge points at the proximal end of the tool, and at a tangent of the circumference of the collar at the distal end of each tool;

each tool configured to rotate away from the body to a plurality of angles; and a second set of tools arranged to rotate in a specific alternating 180 degree sequence;

the second set of tools configured to be positioned at one or more hinge points at the proximal end of the tool, and at a tangent of the circumference of the collar at the distal end of each tool; and each tool configured to rotate away from the body to a plurality of angles, wherein the collar is slideable in one direction in a single action movement;

in a single action movement use, the collar starts/rests when the tools are flush or below flush with the body;

as the collar is moved in a single direction toward one end of the body, an angled wall or ramp in the collar corresponding to a distal tool end pushes against the tip of the tool to raise it away from the body.

2. The utility tool of claim 1, wherein the proximate and distal ends of the tools rotate in either an "L" mode or "screwdriver" mode for use.

3. The utility tool of claim 1, wherein the general cylindrical body also provides angled channels with varying angular depths where the tools are arranged and retained within the general cylindrical body.

4. The utility tool of claim 3, wherein the individual channels are unrelated and not connected from one set or side to any other set or side;

these discrete and individual channels of a first end are offset from the discrete and individual channels of a second end;

the tools and channels extend beyond a center line in the direction of the longitudinal axis;

the discrete and individual offset channels extending beyond the center line form an overlapping arrangements; and the overlapping arrangement sets up alternating keys on the first and second end mounting axes.

5. The utility tool of claim 4, wherein each tool is positioned at an angle such that the distal end sits at the tangent to the circumference of the collar.

6. The utility tool of claim 3, wherein the tools rotate in a specific alternating sequence around a common axis.

7. The utility tool of claim 3, wherein single tools are contained within a single channel; and each channel is set at a varying angular depths from the proximal end of each tool to the distal end of each tool.

8. The utility tool of claim 3, wherein each tool alternates its orientation on a hinge, the largest in the center, and then alternating smaller sizes on either side.

9. The utility tool of claim 3, wherein each channel of the body includes a finger scoop.

10. The utility tool of claim 3, wherein multiple tools are contained within a single channel; and each channel is set at a varying angular depths from the proximal end of each tool to the distal end of each tool.

11. The utility tool of claim 1, wherein the tools are arranged perpendicular to the central longitudinal axis of the body in order to specifically reduce the number of screws required to assemble the unit from four, to one with a mating nut.

12. The utility tool of claim 11, further comprising only one axis per end, of which all tools are assembled around.

13. The utility tool of claim 1, wherein the collar is slideable in two directions in a dual action movement;

in a first action a tool secured to the body end in the direction the collar is pushed is raised away from the body when the collar is push in a first direction; and in a second action, the collar is moved in the opposite direction along the body which results in additional finger space being available.

* * * * *